US005658180A

United States Patent [19]

Takagi

[11] Patent Number: 5,658,180

[45] Date of Patent: Aug. 19, 1997

[54] METHOD FOR AGING A FIELD EMISSION COLD CATHODE

[75] Inventor: Koji Takagi, Shiga, Japan

[73] Assignee: NEC Corporation, Tokyo, Japan

[21] Appl. No.: 594,786

[22] Filed: Jan. 31, 1996

[30] Foreign Application Priority Data

Jan. 31, 1995 [JP] Japan ..... 7-013399

[51] Int. Cl.[6] ..... H01J 9/44

[52] U.S. Cl. ..... 445/6; 445/62

[58] Field of Search ..... 445/6, 62

[56] References Cited

U.S. PATENT DOCUMENTS 4,973,281 11/1990 Nesvizhsky ..... 445/6

5,588,893 12/1996 Kaftanov et al. ..... 445/6

FOREIGN PATENT DOCUMENTS 60-44777 10/1985 Japan ..... 445/6

3-15132 1/1991 Japan ..... 445/6

*Primary Examiner*—P. Austin Bradley

*Assistant Examiner*—Jeffrey T. Knapp

*Attorney, Agent, or Firm*—Young & Thompson

[57] ABSTRACT

The present invention provides a method for aging a field emission cold cathode, wherein a gate electrode of the field emission cold cathode is not applied directly with the voltage. The gate electrode remains floated electrically. A high voltage is applied to either an anode electrode or a convergence electrode so as to generate a field with a sufficiently large intensity for causing electron emission from a pointed top of a cone-shaped cathode toward the anode electrode or the convergence electrode.

4 Claims, 2 Drawing Sheets

METHOD FOR AGING A FIELD EMISSION COLD CATHODE

BACKGROUND OF THE INVENTION

The present invention relates to a method for aging a field emission cold cathode, and particularly to a method for aging a field emission cold cathode with a stable electron emission from a cathode.

A typical field emission cold cathode has a structure as illustrated in FIGS. 1 and 2. A field emission cold cathode 10 is formed on an insulating glass substrate 11. A first electrode 12 is made of aluminum and formed on the insulating substrate 11. The first electrode 12 has openings aligned in matrix and each having a small diameter. A resistive layer 13 is formed over the first electrode 12 and within the openings so that the resistive layer 13 is in contact with the insulating substrate 11. The resistive layer 13 is made of silicon. Cone-shaped cathodes 14 are provided on the resistive layer 13 over the openings of the first electrode 12. The cone-shaped cathodes 14 are aligned in matrix. Each the cone-shaped cathode 14 has a top which is pointed and sharpen. Each the cone-shaped cathode 14 is made of a refractory metal such as tungsten and molybdenum. Each the cone-shaped cathode 14 has the bottom having a diameter slightly smaller than "W". A silicon oxide film 16 is formed on the resistive layer 13. The silicon oxide film 16 has cavities 15 each of which is formed to accommodate each the cone-shaped cathode 14. Each of the cavities 15 has a diameter of "W". A second electrode 17 acting as a gate electrode is formed on the silicon oxide film 16. The gate electrode 17 is positioned at the same level as the tops of the cone-shaped cathodes 14. The gate electrode 17 is made of a refractory metal such as tungsten, molybdenum and niobium or rectal compounds.

In the above field emission cold cathode, an electron emission from the top of each the cone-shaped cathode 14 is caused by a potential difference applied between the cone-shaped cathode 14 and the gate electrode 17 without heating the cathodes 14. It is very important that the electron emission from the top of each the cathode 14 is maintained stable. The field emission cold cathode is subjected to an aging process in order to confirm whether each the cone-shaped cathode can maintain a stable electron emission for a predetermined time duration.

As illustrated in FIG. 3, a field emission electron gun 5 is provided with the field emission cold cathode 10, wherein the field emission electron gun 5 is accommodated within a cathode ray tube 1. In the aging process, the field emission cold cathode 10 is accommodated within the cathode ray tube 1. An anode is applied with a-predetermined anode voltage which is lower than the regulated value. The gate electrode 17 is applied with the regulated voltage. The cone-shaped cathode 14 is grounded. A strong field is generated between the top of the cone-shaped cathode 14 and the gate electrode 17.

Immediately after the field emission cold cathode 10 is made, the electron emission from the top of the field emission cold cathode 10 is likely to be unstable. The discharge of the electron from the top of the field emission cold cathode 10 is variable. If in the aging process the regulated voltage is applied to the gate electrode to apply the high field between the cone-shaped cathode and the gate electrode, an excess discharge is likely to be generated between the gate electrode and the top of the cone-shaped cathode. Such excess large electron emission may cause the cone-shaped cathode 14 to be broken.

To settle this problem, it was proposed to provide a convergence and acceleration electrode which is applied with a negative voltage or which is adjusted to be grounded so as to prevent any excess discharge of electrons from the top of the cone-shaped cathode. This field emission electron gun has the additional convergence and acceleration electrode applied with a voltage signal which has to be controlled precisely. The structure and operations of the above device are somewhat complicated. For this reason, it was required to develop a quite novel method for aging the field emission cold cathode included in the electron gun which has the simple structure as illustrated in FIG. 3.

SUMMARY OF THE INVENTION

Accordingly, it is an object of the present invention to provide a novel method for aging a field emission cold cathode, which is free from the above problems.

The above and other objects, features and advantages of the present invention will be apparent from the following descriptions.

The present invention provides a novel method for aging a field emission cold cathode, wherein a gate electrode of the field emission cold cathode is not applied directly with the voltage. The gate electrode remains floated electrically. A high voltage is applied to either an anode electrode or a convergence electrode so as to generate a field with a sufficiently large intensity for causing electron emission from a pointed top of a cone-shaped cathode toward the anode electrode or the convergence electrode.

According to the present invention, a bias voltage is applied between an anode electrode and a substrate on or over which a cone-shaped cathode is formed is grounded, and a gate electrode electrically floated. The bias voltage is sufficiently large for causing an electron emission from the top of the cone-shaped field emission cathode toward the anode electrode. No bias voltage is applied between the gate electrode and the cone-shaped field emission cathode. This prevents any excess large electron discharge between the gate electrode and the top of the cone-shaped field emission cathode. The gate electrode is much more near the top of the cone-shaped field emission cathode than the anode electrode.

If, however, contrarily to the present invention, a relatively low bias voltage were applied between the gate electrode and the cathode, then a sufficiently strong field is generated, which causes electron emission from the top of the cone-shaped cathode. A relatively small variation in the voltage applied between the gate electrode and the cathode causes a relatively large variation in the intensity of the electron discharge from the top of the cathode. This may raise the issue as to generation of excess large electron discharge from the top of the cathode.

If, in accordance with the present invention, no bias voltage is applied between the gate electrode and the cathode whilst a high bias voltage is applied between the anode electrode and the cathode electrode, then a relatively small variation in the voltage applied between the anode electrode and the cathode electrode causes a relatively small variation in the intensity of the electron discharge from the top of the cathode. This results in no excess large electron discharge from the top of the cathode. This prevents the cathode electrode from being broken due to the excess large electron discharge.

BRIEF DESCRIPTIONS OF THE DRAWINGS

Preferred embodiments of the present invention will be described in detail with reference to the accompanying drawings.

EMBODIMENT

Figure 4:
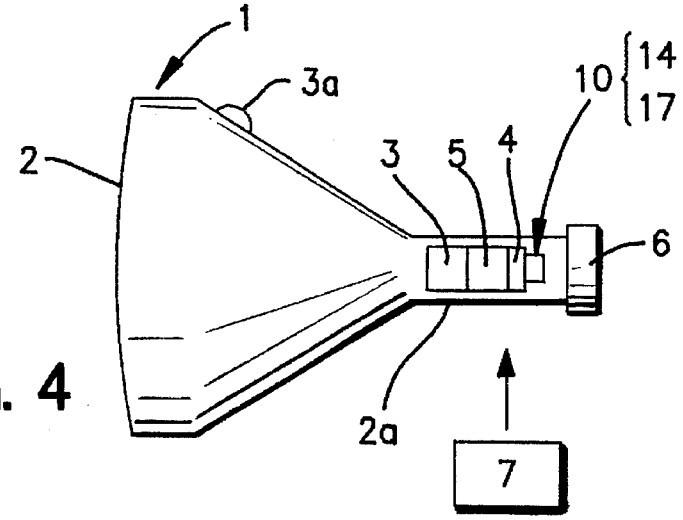
FIG. 4 is a fragmentary cross sectional elevation view illustrative of the field emission electron gun to be subjected to an aging test according to the present invention.

A preferred embodiment according to the present invention will be described with reference to FIGS. 4 and 5 which is illustrative of a novel method for aging the field emission cold cathode included in the field emission electron gun. A cathode ray tube 1 comprises the following elements. A bulb 2 has a neck portion 2*a* which accommodates a field emission electron gun 5. One end of the neck portion 2*a* is united with an expanding portion of the bulb 2 and the opposite end thereof is provided with a socket 6. The field emission electron gun 5 comprises a field emission cold cathode 10, a converge rice electrode 4 and an anode 3. The field emission cold cathode 10 includes a cone-shaped cathode 14 having a sharply pointed top toward the anode 3 and a gate electrode 17 which surrounds and is spaced apart from the top of the cone-shaped cathode 14. An anode terminal is provided on a surface of the expanding portion of the bulb 2. A driving control device 7 is provided to control the driving of the field emission electron gun 5. The driving control device 7 may optionally comprise a high voltage power circuit, an EC power circuit, a deflecting circuit and a driver circuit.

Figure 1:
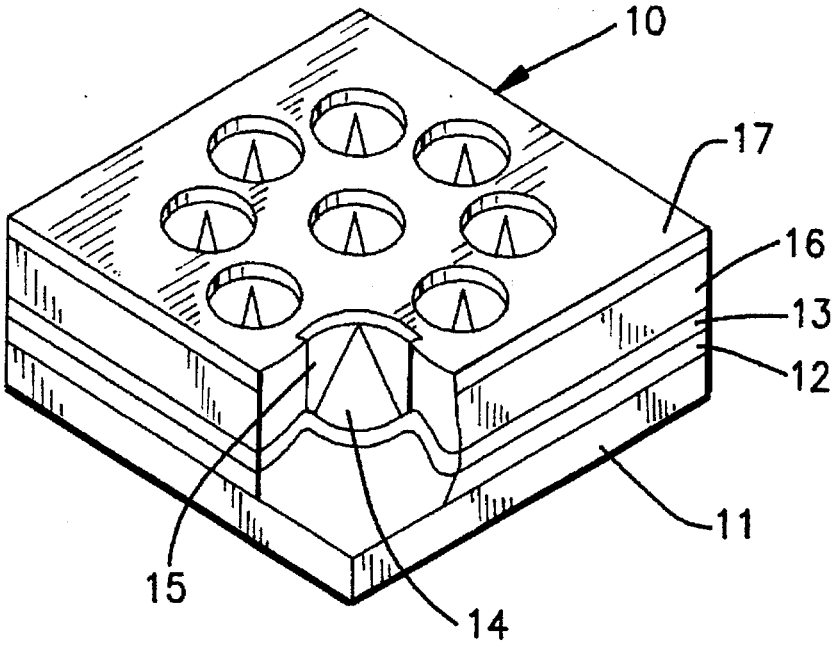
FIG. 1 PRIOR ART
FIG. 1 is a fragmentary perspective view illustrative of the field emission electron gun with cone-shaped cathodes aligned in matrix and formed on an insulating substrate.
Figure 2:
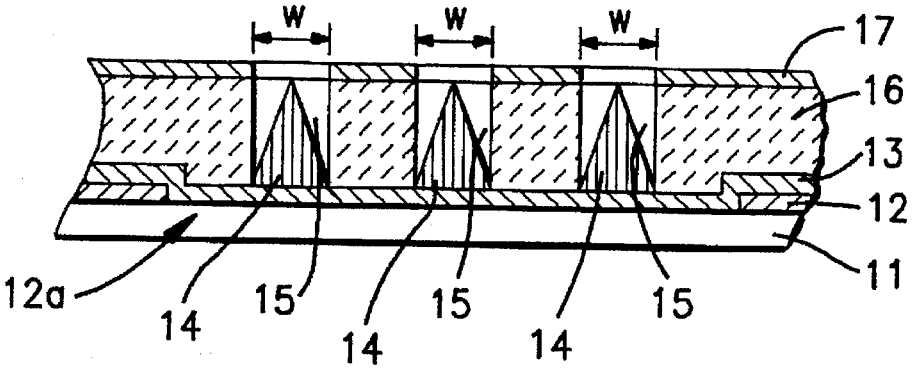
FIG. 2 PRIOR ART
FIG. 2 is a fragmentary cross sectional elevation view illustrative of the field emission electron gun with cone-shaped cathodes aligned in matrix and formed on an insulating substrate.
Figure 3:
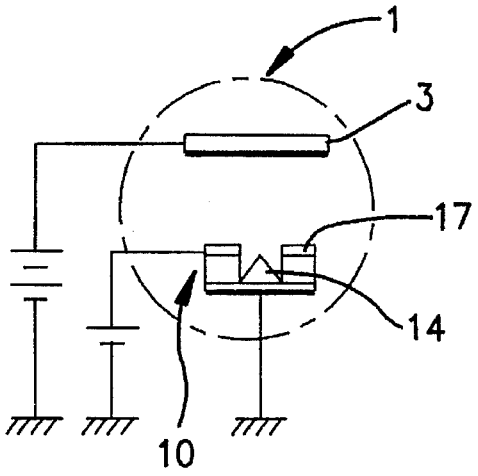
FIG. 3 PRIOR ART
FIG. 3 is a fragmentary cross sectional elevation view illustrative of the conventional method for aging the field emission electron gun.

The field emission cold cathode 10 has cone-shaped cathodes which are aligned in matrix as illustrated in FIG. 1 and each of the cone-shaped cathodes has a very small size in the micron order. The structure of the field emission cold cathode 10 is as illustrated in FIG. 2. The field emission cold cathode 10 is framed on an insulating glass substrate 11. A first electrode 12 made of aluminum is formed on the insulating substrate 11. The first electrode 12 has openings aligned in matrix and each having a small diameter. A resistive layer 13 is formed over the first electrode 12 and within the openings so that the resistive layer 13 is in contact with the insulating substrate 11. The resistive layer 13 is made of silicon. Cone-shaped cathodes 14 are provided on the resistive layer 13 over the openings of the first electrode 12. The cone-shaped cathodes 14 are aligned in matrix. Each the cone-shaped cathode 14 has a top which is pointed and sharpen. Each the cone-shaped cathode 14 is made of a refractory metal such as tungsten and molybdenum. Each the cone-shaped cathode 14 has the bottom having a diameter slightly smaller than "W". A silicon oxide film 16 is formed on the resistive layer 13. The silicon oxide film 16 has cavities 15 each of which is formed to accommodates each the cone-shaped cathode 14. Each of the cavities 15 has a diameter of "W". A second electrode 17 acting as a gate electrode is formed on the silicon oxide film 16. The gate electrode 17 is positioned at the same level as the tops of the cone-shaped cathodes 14. The gate electrode 17 is made of a refractory metal with a low work function such as tungsten, molybdenum and niobium or metal compounds.

Figure 5:
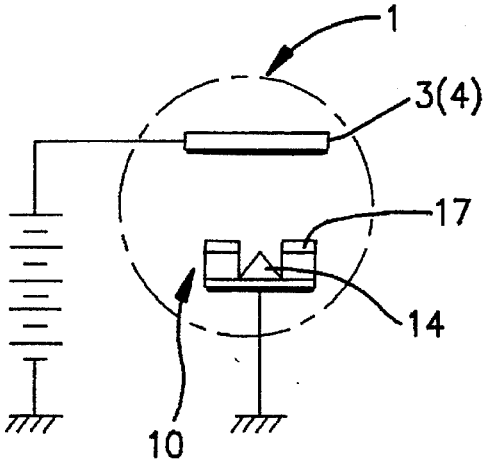
FIG. 5 is a fragmentary cross sectional elevation view illustrative of a novel method for aging the field emission electron gun according to the present invention.

As illustrated in FIG. 5, a bias voltage of a few voltages is applied between the anode electrode 3 and the cathode 14 so that a high field of about $1\times10^7$ v/cm or more is generated between the anode electrode 3 and the cathode 14 to thereby cause an electron emission from the top of the cone-shaped cathode 14 without heating the cathode 14. The bias is applied by applying the anode electrode 3 with the positive voltage and making the cathode 14 grounded. The gate electrode 17 is, however, electrically floated. In other words, no bias voltage is applied between the gate electrode 17 and the cone-shaped cathode 14. This prevents any accidental excess large electron discharge between the gate electrode 17 and the top of the cone-shaped field emission cathode 14. The gate electrode 17 is positioned much more near the top of the cone-shaped field emission cathode 14 than the anode electrode 3.

If, contrarily to the present invention, a relatively low bias voltage were applied between the gate electrode 17 and the cathode 14, then a sufficiently strong field is generated, which causes electron emission from the top of the cone-shaped cathode 14. A relatively small variation in the voltage applied between the gate electrode 17 and the cathode 14 causes a relatively large variation in the intensity of the electron discharge from the top of the cathode 14. This may raise the issue as to generation of excess large electron discharge from the top of the cathode 14.

In accordance with the present invention, no bias voltage is applied between the gate electrode 17 and the cathode 14, and a high bias voltage is applied between the anode electrode 3 and the cathode electrode 14, then a relatively small variation in the voltage applied between the anode electrode 3 and the cathode electrode 14 causes a relatively small variation in the intensity of the electron discharge from the top of the cathode 14. This results in a stable electron emission from the top of the cathode 14 and no excess large electron emission. This prevents the cathode electrode from being broken due to the excess large electron discharge.

No power supply is needed, which supplies a voltage to the gate electrode 17. This results in a simple structure of the driver and control circuits for driving and controlling the field emission electron gun. It is preferable that the top of the cathode electrode is positioned at the center of an circular area surrounded by the gate electrode.

As a modification, it is available that a plurality of the field emission cold cathodes are accommodated in a single tube having a single anode electrode, so that the aging test for the plural field emission cold cathodes may be carried out by applying the bias voltage between the anode terminal electrically connected to the anode and the socket electrically connected to the cathodes.

Whereas modifications of the present invention will no doubt be apparent to a person having ordinary skill in the art, to which the invention pertains, it is to be understood that embodiments shown and described by way of illustrations are by no means intended to be considered in a limiting sense. Accordingly, it is to be intended to cover by claims all modifications which fall within the spirit and scope of the present invention.

What is claimed is:

1. A method for aging a field emission cold cathode included in a field emission electron gun which comprises at least one cone-shaped cathode, at least one gate electrode corresponding to said at least one cone-shaped cathode and an anode, said method comprising the steps of electrically floating said at least one gate electrode, and applying a bias between said anode and said at least one cone-shaped cathode to thereby generate a field having a sufficiently large intensity for causing electron emission from a pointed top of each said at least one cone-shaped cathode toward said anode.

2. The method as claimed in claim 1, wherein a positive high voltage is applied to said anode and a ground voltage is applied to said cathode.

3. A method for aging a field emission cold cathode included in a field emission electron gun which comprises at least one cone-shaped cathode, at least one gate electrode corresponding to said at least one cone-shaped cathode, an anode and a convergence electrode positioned between said anode and said at least one gate electrode, said method comprising the steps of electrically floating said at least one gate electrode, and applying a bias to between said convergence electrode and said at least one cone-shaped cathode to thereby generate a field having a sufficiently large intensity for causing electron emission from a pointed top of each said at least one cone-shaped cathode toward said convergence electrode.

4. The method as claimed in claim 3, wherein a positive high voltage is applied to said convergence electrode and a ground voltage is applied to said cathode.

* * * * *